US009631641B2

(12) United States Patent
Choi

(10) Patent No.: US 9,631,641 B2
(45) Date of Patent: Apr. 25, 2017

(54) PUMP SYSTEM AND ITS CONTROLLING METHOD FOR CLEANING STRAINER

(71) Applicant: Byoung Hwa Choi, Hanam-si (KR)

(72) Inventor: Byoung Hwa Choi, Hanam-si (KR)

( * ) Notice: Subject to any disclaimer, the term of this patent is extended or adjusted under 35 U.S.C. 154(b) by 0 days.

(21) Appl. No.: 15/136,045

(22) Filed: Apr. 22, 2016

(65) Prior Publication Data

US 2016/0377094 A1 Dec. 29, 2016

(30) Foreign Application Priority Data

Jun. 25, 2015 (KR) ..... 10-2015-0090234

(51) Int. Cl.

| | |
|---|---|
| ***F04D 29/70*** | (2006.01) |
| ***F04D 13/14*** | (2006.01) |
| ***F04D 1/00*** | (2006.01) |
| ***F04D 15/02*** | (2006.01) |
| ***F04B 23/04*** | (2006.01) |
| ***F04D 13/12*** | (2006.01) |

(52) U.S. Cl.

CPC ..... *F04D 29/708* (2013.01); *F04B 23/04* (2013.01); *F04D 1/00* (2013.01); *F04D 13/12* (2013.01); *F04D 13/14* (2013.01); *F04D 15/029* (2013.01)

(58) Field of Classification Search

None

See application file for complete search history.

(56) References Cited

U.S. PATENT DOCUMENTS

| | | | | | |
|---|---|---|---|---|---|
| 1,150,086 | A * | 8/1915 | Willemstyn | B01D 35/12 | 210/299 |
| 2,125,532 | A * | 8/1938 | Wells | B01D 29/118 | 208/177 |
| 2,681,736 | A * | 6/1954 | Voorheis | B01D 35/12 | 137/625.29 |
| 3,618,781 | A * | 11/1971 | Brown | B01D 35/12 | 137/545 |
| 3,679,060 | A * | 7/1972 | Smith | B01D 35/12 | 210/333.1 |
| 4,495,072 | A * | 1/1985 | Fields | B01D 29/17 | 210/238 |
| 4,745,943 | A * | 5/1988 | Mortensen | B01D 45/04 | 137/177 |
| 4,923,068 | A * | 5/1990 | Crowson | B01D 29/60 | 210/108 |

(Continued)

*Primary Examiner* — Robert James Popovics

(74) *Attorney, Agent, or Firm* — Rabin & Berdo, P.C.

(57) ABSTRACT

Provided are a pump system with pumps aligned parallel to each other and a method for cleaning strainers easily and conveniently. Provided are the pump system and the method of controlling the same by which the frequent block of the strainers by particulates and/or debris and thereby the cleaning of the strainers can be done easily. Provided are the pump system and the method of controlling the same by which the time loss and expenses can be saved much in contrast to conventional pump systems occurring the efforts to loosen and tighten each of the bolts of the strainer during the exchange of the strainers, inconvenience and expenses loss of gasket exchange and its damages during the cover disassembled, and needs to remove insulating means and heat new insulating means, thereby to minimize the efforts in management of the pump system and save time and expenses thereof.

3 Claims, 3 Drawing Sheets

(56) References Cited

U.S. PATENT DOCUMENTS 5,149,449 A * 9/1992 Strid ..... B01D 29/39 210/167.31
5,217,509 A * 6/1993 Jansen ..... B01D 46/0004 55/283
5,322,623 A * 6/1994 Benskin ..... B01D 36/02 210/195.1
5,401,397 A * 3/1995 Moorehead ..... B01D 29/114 210/108
5,443,722 A * 8/1995 Desai ..... B01D 29/35 137/625.21
5,595,656 A * 1/1997 Yun ..... B01D 29/114 210/313
5,772,879 A * 6/1998 Jaikaran ..... B01D 46/10 210/107
5,863,443 A * 1/1999 Mainwaring ..... B01D 21/0012 210/248
6,056,797 A * 5/2000 Richard ..... B01D 41/04 55/302
6,719,900 B2 * 4/2004 Hawkins ..... B01D 29/118 210/248
7,896,959 B1 * 3/2011 Schopf, Jr. ..... B01D 46/0012 210/340
8,794,263 B2 * 8/2014 Scott ..... B01D 46/0058 137/599.14
8,961,792 B2 * 2/2015 Desai ..... B01D 35/12 210/234
9,345,994 B2 * 5/2016 Morris ..... E03B 7/074
2003/0183587 A1 * 10/2003 Hawkins ..... B01D 29/118 210/787
2005/0023196 A1 * 2/2005 Ku ..... B01D 35/02 210/90
2012/0000835 A1 * 1/2012 Desai ..... B01D 35/12 210/137
2014/0027357 A1 * 1/2014 Morris ..... E03B 7/074 210/85
2016/0377094 A1 * 12/2016 Choi ..... F04D 29/708 210/798

* cited by examiner

PUMP SYSTEM AND ITS CONTROLLING METHOD FOR CLEANING STRAINER

CROSS-REFERENCE TO RELATED APPLICATION

This application claims the benefit of Korean Patent Application No. 10-2015-0090234, filed Jun. 25, 2015, the disclosure of which is hereby incorporated herein by reference in its entirety.

BACKGROUND OF THE INVENTION

1. Technical Field

The present invention relates to a pump system and a method of controlling the same for cleaning strainer, and more particularly, to a pump system configured and operated to clean the strainers, which are essential components in normal pumps, easily and conveniently, and a method of controlling the same for cleaning strainer.

2. Discussion of Related Art

Pumps are normally used for pumping fluids such as water by using the centrifugal force of an impeller rotated by a motor through a suction part to a discharge pipe. They are widely used in a variety of purposes and places including crop irrigation, wastewater disposal, building construction, etc. in order to pump underground water, wastewater, floodwater, industrial usage water, etc.

Typically, strainers are installed in the pump system in order to filter and inhibit solid particulates and/or debris inside the water under the pump or inside pump pipes.

FIG. 1 is a schematic view of a typical pump system with strainers installed in the lower side of the pump. Such typical pump system includes a main pump side (depicted in A line of the drawing) and a stand-by pump side (depicted in B line of the drawing), and while the A line pump operates, the B line pump is stopped.

FIG. 1 shows a parallel-type pump system with the A line pump and the B line pump aligned in parallel, which are respectively composed of pump components of main and stand-by butterfly valves 11 and 21, main and stand-by check valves 12 and 22, main and stand-by circulation pumps 13 and 23, main and stand-by strainers 14 and 24, and main and stand-by butterfly valves 15 and 25.

The strainer is composed of a net or metal plate having a plurality of filtering holes. As such, the strainers 14 and 24 are positioned the inlet of the circulation pumps 13 and 23 with connected thereto.

The circulation pumps 13 and 23 operate so that water passes through the strainers 14 and 24 and is suctioned into the pump inlet and drained out through the pump outlet. During this operation, the contaminants inside the water such as solid particulates and/or debris are filtered by the filtering holes (not shown) of the strainers 14 and 24. The strainers 14 and 24 function as filter to inhibit particulates and/or debris from entering the inside of the pump system.

In the pump operation as such, the filtering holes of the strainers 14 and 24 are blocked by greater sized contaminants not passing through the holes when fluid such as underground water, waste water, etc. is suctioned up from the fluid source to the pump pipes.

When the water is further restricted to flow through the strainers and the flow size of the strainers 14 and 24 permitting the water flow is further reduced, the suction ability of the circulation pumps 12 and 22 is rapidly decreased and the pumping performance is rapidly decreased because motor energy unnecessarily otherwise is lost so as to cause overload in its motor.

Further, the increase of contaminants entrapment in the strainers brings a problem of decreasing the pumping capacity as failing to pump enough fluid as desired to optimal value and reach the target amount and difficulties in controlling the fluid flow.

While such pumps operate for long time and the pumping suction is further reduced because the particulates/debris are increased in the strainers and water flow is blocked by such strainers, the strainers need to clean frequently or to be removed for exchange, but the pumping operation of the pump system needs to be stopped so as to cause loss of time and efforts.

Further, the cleaning and/or the exchange of the strainers may cause inconveniences and difficulties of damaging the gasket when loosen each bolt of the strainers and removing the insulating means when take its cover apart and making insulation material being heated.

SUMMARY OF THE INVENTION

Therefore, the present invention is directed to provide a pump system having pumps positioned parallel to each other and a method of controlling thereof, for easily cleaning its strainers which are frequently blocked during the operation of pumps.

The present invention is directed to provide a pump system composed of a main circulation pump and a stand-by circulation pump disposed parallel to each other, and a main strainer and a stand-by strainer attached to the upstream positions in the inlets of the pumps respectively, for cleaning strainers easily and a method of controlling thereof, by attaching drain valves to the threshold position of the main strainer and the stand-by strainer respectively, installing a main by-pass valve and a stand-by by-pass valve in the main circulation pump and the stand-by circulation pump respectively, in order to clean each strainer, by making water flow backward in relation to the flow direction of water through each strainer so as to easily clean the particulates/debris built up in the strainers.

In accordance with an exemplary embodiment, the present invention provides a pump system for cleaning strainer comprising: a main circulation pump and a stand-by circulation pump disposed parallel to each other; a main strainer and a stand-by strainer attached to the upstream positions in the inlets of the main circulation pump and the stand-by circulation pump respectively; drain valves installed at the threshold position to the main strainer and the stand-by strainer respectively; and a main by-pass valve and a stand-by by-pass valve installed in the main circulation pump and the stand-by circulation pump respectively, in which in order to clean the main strainer, the main circulation pump is turned OFF, and the stand-by circulation pump is made to operate so that water passes through the main by-pass valve and passes through the outlet of the main strainer and passes through the inside of the main strainer for backwash and is drained out through the main drain valve; and in order to clean the stand-by strainer, the stand-by circulation pump is turned OFF, and the main circulation pump is made to operate so that water passes through the stand-by by-pass valve and passes through the outlet of the stand-by strainer and passes through the inside of the stand-by strainer for backwash and is drained out through the stand-by drain valve.

According to the present invention, time loss of loosen and tighten the bolts of the strainer when exchanging the strainers, inconvenience and expenses loss of replace gasket when it occurs of damages in the gasket at the cover disassembling, no needs to remove insulating means and heat new insulating means, and minimize the efforts in management of the pump system so as to save time and expenses thereof.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided as teaching examples of the invention.

Figure 1:
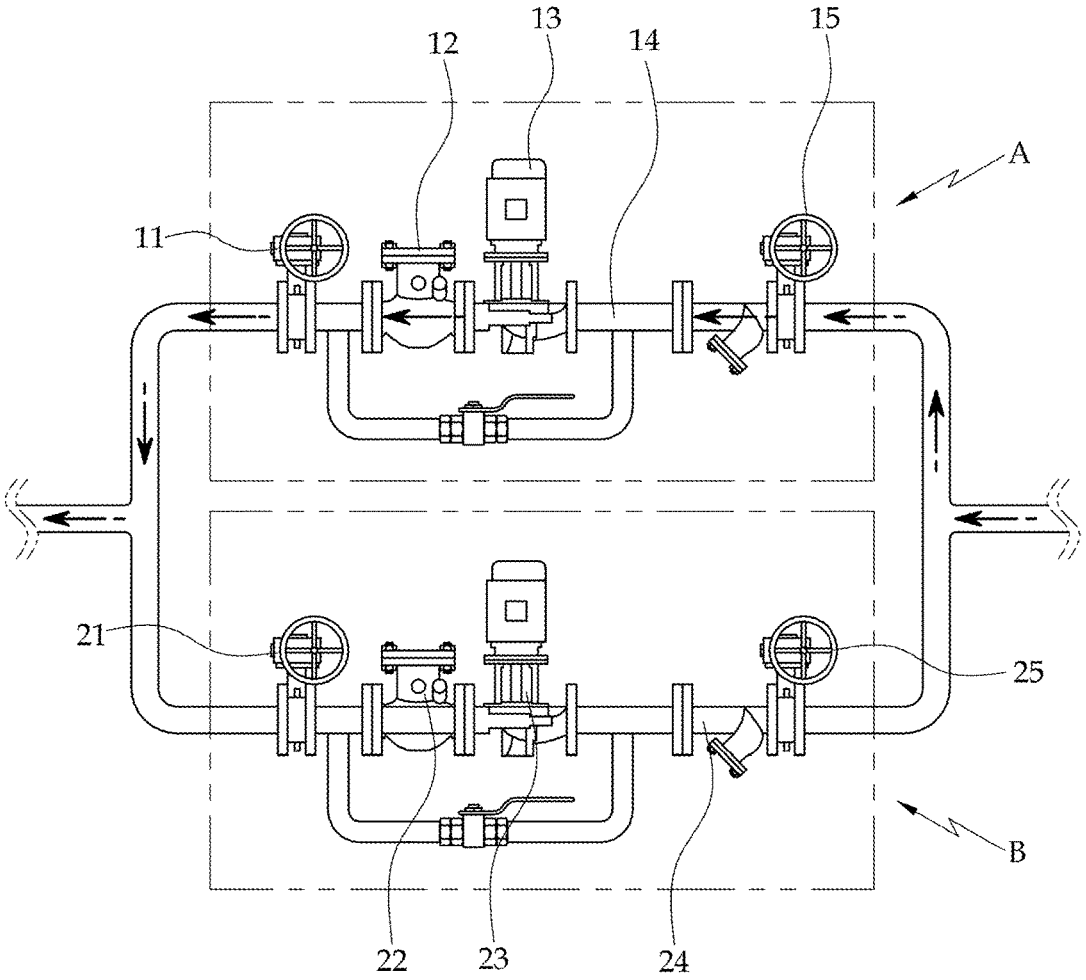
FIG. 1 is a schematic view of a typical pump system with pumps aligned parallel to each other.
Figure 2:
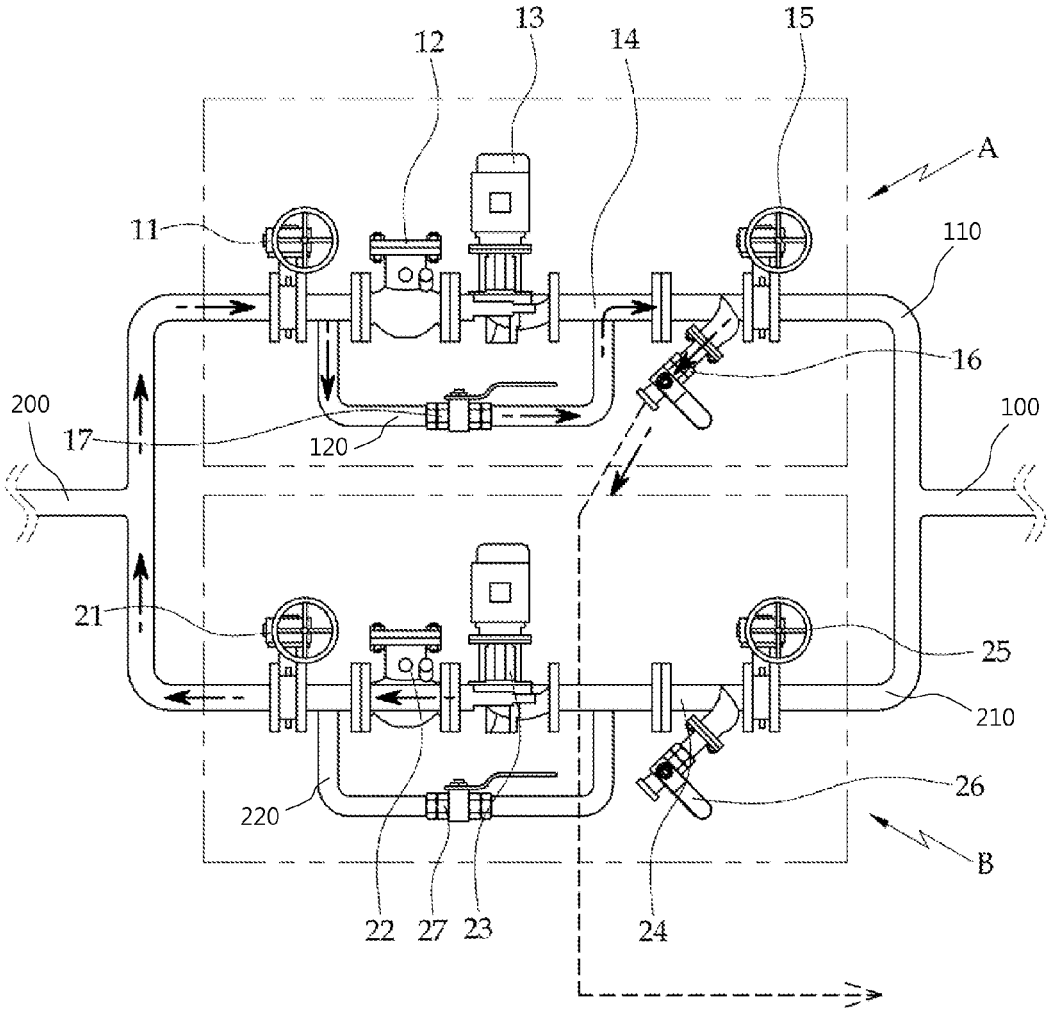
FIG. 2 is a schematic view of a parallel-type pump system according to the present invention showing the cleaning of a main strainer.
Figure 3:
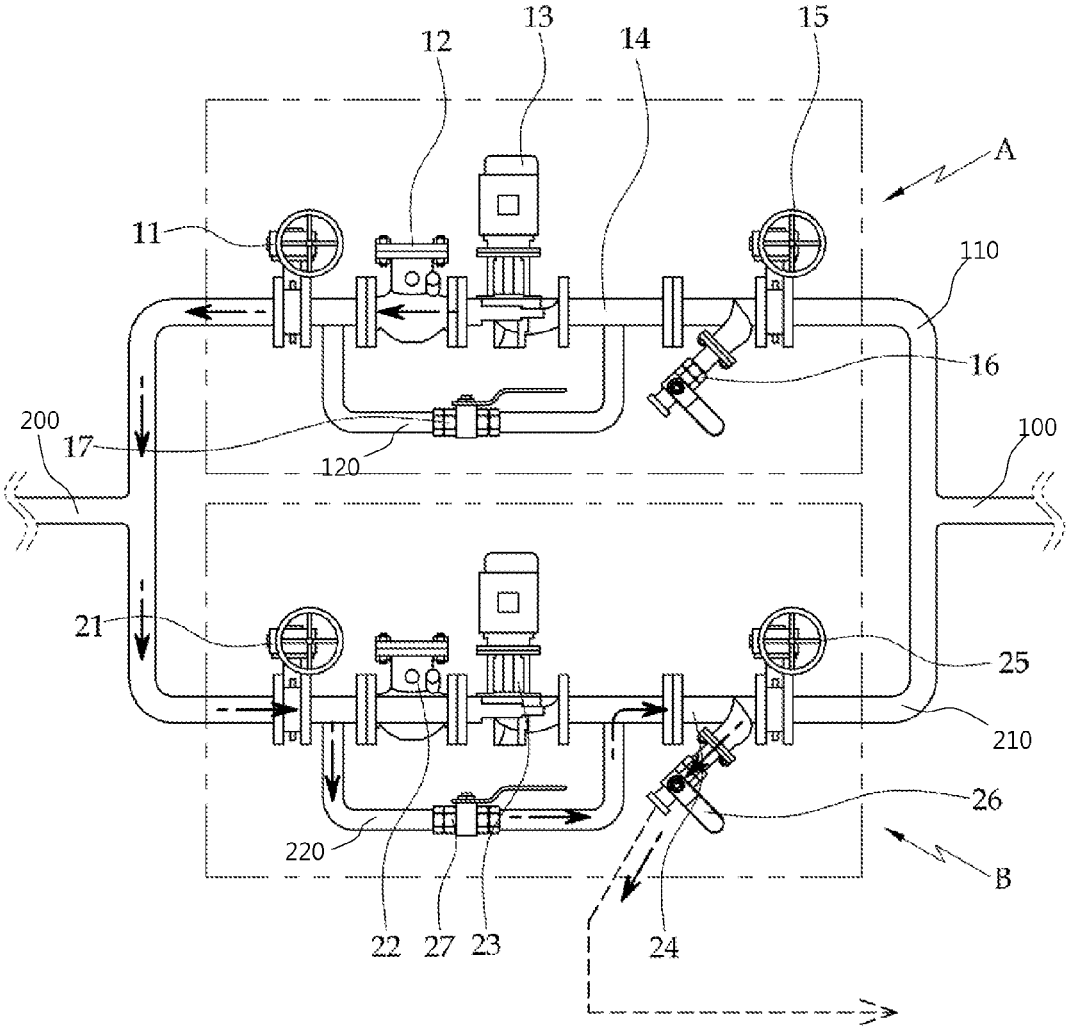
FIG. 3 is a schematic view of a parallel-type pump system according to the present invention showing the cleaning of a stand-by strainer.

FIGS. 2 and 3 are schematic views of a parallel-type pump system according to the present invention showing the cleaning of a main strainer and a stand-by strainer.

Below, the present invention will be described in detail.

The pump system for cleaning strainer in accordance with the present invention includes a supply pipe 100 for supplying such as underground water, waste water, from the fluid source, a discharge pipe 200 for discharging filtered water to a destination, a main pipe 110 and a stand-by pipe 210 which are diverged from the supply pipe 100 and converged into the discharge pipe 200, wherein the main pipe and the stand-by pipe are installed in parallel with each other. Also, the pump system includes a first main and stand-by butterfly valves 15 and 25 in the main pipe 110 and the stand-by pipe 210, respectively; a main circulation pump 13 and a stand-by circulation pump 23 disposed parallel to each other; a main strainer 14 and a stand-by strainer 24 attached to the upstream positions in the inlets of the main circulation pump 13 and the stand-by circulation pump 23 respectively; a main and stand-by check valves 12 and 22 next to the main and stand-by circulation pumps 13 and 23, respectively; a second main and stand-by butterfly valves 11 and 21 next to the main and stand-by check valves 12 and 22, respectively; drain valves 16 and 26 attached to the threshold position to the main strainer 14 and the stand-by strainer 24 respectively; a main by-pass pipe 120 connected in parallel with the main circulation pump 13 and the main check valve 12; a stand-by by-pass pipe 220 connected in parallel with the stand-by circulation pump 23 and the stand-by check valve 22; and a main by-pass valve 17 installed in the main by-pass pipe 120 and a stand-by by-pass valve 27 installed in the stand-by by-pass pipe 220. In order to clean the main strainer 14, the main circulation pump 13 is turned OFF, and the stand-by circulation pump 23 is made to operate so that water passes through the main by-pass valve 17 and passes through the outlet of the main strainer 14 and passes through the inside of the main strainer 14 for backwash and is drained out through the main drain valve 16. In contrast, in order to clean the stand-by strainer 24, the stand-by circulation pump 23 is turned OFF, and the main circulation pump 13 is made to operate so that water passes through the stand-by by-pass valve 27 and passes through the outlet of the stand-by strainer 24 and passes through the inside of the stand-by strainer 24 for backwash and is drained out through the stand-by drain valve 26.

Further, in accordance with the method of controlling the pump system for cleaning its strainers of the present invention, the pump system including a main circulation pump 13 and a stand-by circulation pump 23 disposed parallel to each other, and a main strainer 14 and a stand-by strainer 24 attached to the upstream positions in the inlets of the pumps respectively, the method comprises in order to clean the main strainer 14, turning OFF the main circulation pump 13; turning ON the stand-by circulation pump 23; opening the main by-pass valve 17; and opening the main drain valve 16, and in order to clean the stand-by strainer 24, turning OFF the stand-by circulation pump 23; turning ON the main circulation pump 13; opening the stand-by by-pass valve 27; and opening the stand-by drain valve 26.

An embodiment of the present invention will be described in more detail as below.

The present invention provides a parallel pump system in which a main circulation pump 13 and a stand-by circulation pump 23 are positioned parallel to each other, and which is characterized in that a main strainer 14 and a stand-by strainer 24 are attached the upstream positions to the inlets of the main circulation pump 13 and the stand-by circulation pump 23 respectively.

The strainer functions to filter or strain solid particulates and/or debris from the water flow of the pump. While the pumps operate for long, excessive particulates/debris are entrapped in the strainer which needs to clean frequently. Typically, the pipes component parts connected to the strainer had to be dissolved in order to perform the cleaning, so that the pump system had to be stopped so as to cause the loss of production yields. Furthermore, the cleaning operation by dissolving the parts brings the problem of damages of the components parts.

For this purpose, drain valves 16 and 26 are respectively installed at the threshold position to the main strainer 14 and the stand-by strainer 24, and a main by-pass valve 17 and a stand-by by-pass valve 27 are respectively installed in the main circulation pump 13 and the stand-by circulation pump 23.

In order to clean the main strainer 14, the main circulation pump 13 is OFF, and the stand-by circulation pump 23 operates. Water passes through the main by-pass valve 17 and the discharge part of the main strainer 14 so as to pass the inside of the main strainer 14. The particulates/debris accumulated inside the main strainer 14 can be removed by backwash as above and can be drained through the main drain valve 16 out of the pump.

In order to clean the stand-by strainer 24, the stand-by circulation pump 27 is turned OFF, and the main circulation pump 13 is made to operate so that water passes through the stand-by by-pass valve 27 and passes through the outlet of the stand-by strainer 24 and passes through the inside of the stand-by strainer 24 for backwash and is drained out through the stand-by drain valve 26.

It is not necessary to stop the operation of the pumps in the pump system for long by using the backwash as above, and the cleaning of the strainers can be done just within 10 minutes. Further, the present invention provides the pump system by which pipes components of the pump system not need to be dissolved, nor reset up.

In accordance with the method of controlling a pump system for cleaning strainers easily and conveniently which is composed of a main circulation pump 13 and a stand-by circulation pump 23 disposed parallel to each other, and a main strainer 14 and a stand-by strainer 24 attached to the upstream positions in the inlets of the pumps 13 and 23 respectively, the method comprises in order to clean the main strainer 14, turning OFF the main circulation pump 13; turning ON the stand-by circulation pump 23; opening the main by-pass valve 17; and opening the main drain valve 16, and in order to clean the stand-by strainer 24, turning OFF the stand-by circulation pump 23; turning ON the main circulation pump 13; opening the stand-by by-pass valve 27; and opening the stand-by drain valve 26.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A pump system for cleaning strainer comprising:

a supply pipe supplying water including solid particulates from a source;

a discharge pipe discharging filtered water to a destination;

a main pipe and a stand-by pipe diverged from the supply pipe and converged into the discharge pipe, wherein the main pipe and the stand-by pipe are installed in parallel with each other;

a first main butterfly valve disposed at the main pipe;

a first stand-by butterfly valve disposed at the stand-by pipe;

a main strainer disposed at the main pipe next to the first main butterfly valve;

a stand-by strainer disposed at the stand-by pipe next to the first stand-by butterfly valve;

a main circulation pump disposed at the main pipe next to the main strainer;

a stand-by circulation pump disposed at the stand-by pipe next to the stand-by strainer;

a main check valve disposed at the main pipe next to the main circulation pump;

a stand-by check valve disposed at the stand-by pipe next to the stand-by circulation pump;

a second main butterfly valve disposed at the main pipe next to the main check valve;

a second stand-by butterfly valve disposed at the stand-by pipe next to the stand-by check valve;

a main drain valve installed at the main pipe between the first main butterfly valve and the main strainer;

a stand-by drain valve installed at the stand-by pipe between the first stand-by butterfly valve and the stand-by strainer;

a main by-pass pipe having a first end and a second end, wherein the first end of the main by-pass pipe is connected to the main pipe between the main strainer and the main circulation pump, and the second end of the main by-pass pipe is connected to the main pipe between the main check valve and the second main butterfly valve;

a main by-pass valve disposed at the main by-pass pipe;

a stand-by by-pass pipe having a first end and a second end, wherein the first end of the stand-by by-pass pipe is connected to the stand-by pipe between the stand-by strainer and the stand-by circulation pump, and the second end of the stand-by by-pass pipe is connected to the stand-by pipe between the stand-by check valve and the second stand-by butterfly valve;

a stand-by by-pass valve disposed at the stand-by by-pass pipe;

wherein the first main butterfly valve, the main strainer, the main circulation pump, the main check valve and the second main butterfly valve are disposed in order at the main pipe, and the first stand-by butterfly valve, the stand-by strainer, the stand-by circulation pump, the stand-by check valve and the second stand-by butterfly valve are disposed in order at the stand-by pipe, and wherein when the main circulation pump is turned off, the stand-by circulation pump is turned on and the main by-pass valve is open, the filtered water from the stand-by pipe passes through the second main butterfly valve, the main by-pass valve and the main strainer in order, whereby the filtered water cleans the main strainer.

2. A method of controlling a pump system, the pump system comprising:

a supply pipe supplying water including solid particulates from a source;

a discharge pipe discharging filtered water to a destination;

a main pipe and a stand-by pipe diverged from the supply pipe and converged into the discharge pipe, wherein the main pipe and the stand-by pipe are installed in parallel with each other;

a first main butterfly valve disposed at the main pipe;

a first stand-by butterfly valve disposed at the stand-by pipe;

a main strainer disposed at the main pipe next to the first main butterfly valve;

a stand-by strainer disposed at the stand-by pipe next to the first stand-by butterfly valve;

a main circulation pump disposed at the main pipe next to the main strainer;

a stand-by circulation pump disposed at the stand-by pipe next to the stand-by strainer;

a main check valve disposed at the main pipe next to the main circulation pump;

a stand-by check valve disposed at the stand-by pipe next to the stand-by circulation pump;

a second main butterfly valve disposed at the main pipe next to the main check valve;

a second stand-by butterfly valve disposed at the stand-by pipe next to the stand-by check valve;

a main drain valve installed at the main pipe between the first main butterfly valve and the main strainer;

a stand-by drain valve installed at the stand-by pipe between the first stand-by butterfly valve and the stand-by strainer;

a main by-pass pipe having a first end and a second end, wherein the first end of the main by-pass pipe is connected to the main pipe between the main strainer and the main circulation pump, and the second end of the main by-pass pipe is connected to the main pipe between the main check valve and the second main butterfly valve;

a main by-pass valve disposed at the main by-pass pipe;

a stand-by by-pass pipe having a first end and a second end, wherein the first end of the stand-by by-pass pipe is connected to the stand-by pipe between the stand-by strainer and the stand-by circulation pump, and the second end of the stand-by by-pass pipe is connected to the stand-by pipe between the stand-by check valve and the second stand-by butterfly valve;

a stand-by by-pass valve disposed at the stand-by by-pass pipe;

wherein the first main butterfly valve, the main strainer, the main circulation pump, the main check valve and the second main butterfly valve are disposed in order at the main pipe, and the first stand-by butterfly valve, the stand-by strainer, the stand-by circulation pump, the stand-by check valve and the second stand-by butterfly valve are disposed in order at the stand-by pipe, the method comprising:

turning OFF the main circulation pump;

turning ON the stand-by circulation pump;

opening the main by-pass valve; and opening the main drain valve, whereby the filtered water from the stand-by pipe passes through the second main butterfly valve, the main by-pass valve and the main strainer in order and cleans the main strainer.

3. A method of controlling a pump system, the pump system comprising:

a supply pipe supplying water including solid particulates from a source;

a discharge pipe discharging filtered water to a destination;

a main pipe and a stand-by pipe diverged from the supply pipe and converged into the discharge pipe, wherein the main pipe and the stand-by pipe are installed in parallel with each other;

a first main butterfly valve disposed at the main pipe;

a first stand-by butterfly valve disposed at the stand-by pipe;

a main strainer disposed at the main pipe next to the first main butterfly valve;

a stand-by strainer disposed at the stand-by pipe next to the first stand-by butterfly valve;

a main circulation pump disposed at the main pipe next to the main strainer;

a stand-by circulation pump disposed at the stand-by pipe next to the stand-by strainer;

a main check valve disposed at the main pipe next to the main circulation pump;

a stand-by check valve disposed at the stand-by pipe next to the stand-by circulation pump;

a second main butterfly valve disposed at the main pipe next to the main check valve;

a second stand-by butterfly valve disposed at the stand-by pipe next to the stand-by check valve;

a main drain valve installed at the main pipe between the first main butterfly valve and the main strainer;

a stand-by drain valve installed at the stand-by pipe between the first stand-by butterfly valve and the stand-by strainer;

a main by-pass pipe having a first end and a second end, wherein the first end of the main by-pass pipe is connected to the main pipe between the main strainer and the main circulation pump, and the second end of the main by-pass pipe is connected to the main pipe between the main check valve and the second main butterfly valve;

a main by-pass valve disposed at the main by-pass pipe;

a stand-by by-pass pipe having a first end and a second end, wherein the first end of the stand-by by-pass pipe is connected to the stand-by pipe between the stand-by strainer and the stand-by circulation pump, and the second end of the stand-by by-pass pipe is connected to the stand-by pipe between the stand-by check valve and the second stand-by butterfly valve;

a stand-by by-pass valve disposed at the stand-by by-pass pipe;

wherein the first main butterfly valve, the main strainer, the main circulation pump, the main check valve and the second main butterfly valve are disposed in order at the main pipe, and the first stand-by butterfly valve, the stand-by strainer, the stand-by circulation pump, the stand-by check valve and the second stand-by butterfly valve are disposed in order at the stand-by pipe, the method comprising:

turning OFF the stand-by circulation pump;

turning ON the main circulation pump;

opening the stand-by by-pass valve; and opening the stand-by drain valve, whereby the filtered water from the main pipe passes through the second stand-by butterfly valve, the stand-by by-pass valve and the stand-by strainer in order and cleans the stand-by strainer.

* * * * *